US005110678A

United States Patent [19]

Narukawa et al.

[11] Patent Number: 5,110,678

[45] Date of Patent: May 5, 1992

[54] SYNTHETIC POLYVINYL ALCOHOL FIBER AND PROCESS FOR ITS PRODUCTION

[75] Inventors: Hiroshi Narukawa, Soja; Akio Mizobe, Okayama; Fumio Nakahara, Kurashiki; Akira Kubotsu, Soja; Akitsugu Akiyama, Soji; Masakazu Nishiyama, Okayama; Kenji Nagamatu; Hirotoshi Miyazaki, both of Kurashiki, all of Japan

[73] Assignee: Kuraray Company Limited, Kurashiki, Japan

[21] Appl. No.: 512,104

[22] Filed: Apr. 20, 1990

[30] Foreign Application Priority Data

Apr. 27, 1989 [JP] Japan ..... 1-109998
Aug. 4, 1989 [JP] Japan ..... 1-203141
Oct. 30, 1989 [JP] Japan ..... 1-283636

[51] Int. Cl.[5] ..... D02G 3/00

[52] U.S. Cl. ..... 428/364; 264/147; 264/185; 428/357; 428/359

[58] Field of Search ..... 428/364, 357, 359; 524/173; 264/210.8, 185, 147

[56] References Cited

U.S. PATENT DOCUMENTS 3,852,402 12/1974 Tanaka et al. ..... 264/210.2 X
3,932,574 1/1976 Shiraishi et al. ..... 264/210.7 X
4,698,194 10/1987 Tanaka et al. ..... 264/210.8 X
4,713,290 12/1987 Kwon et al. ..... 264/210.8 X
4,765,937 8/1988 Hyon et al. ..... 264/210.8 X
4,851,168 7/1989 Graiver et al. ..... 524/173 X

*Primary Examiner*—Lorraine T. Kendell
*Attorney, Agent, or Firm*—Oblon, Spivak, McClelland, Maier & Neustadt

[57] ABSTRACT

Provided is a high-performance PVA fiber and its production.

Each filament of the PVA fiber of the present invention having a structure comprising an aggregate of substantially innumerable fibrils, the fiber has high strength, elastic modulus, and resistances to fatigue, hot water and chemicals and can be pulpified while keeping its excellent features such as high strength. The PVA fiber of the present invention cannot, even drawn to a high ratio, be readily whitened by virtue of its fibril-aggregate structure, and can hence be made still higher in performances. The PVA fiber can be obtained by adding to a PVA solution a relatively large amount of surface active agent, and wet or dry-jet-wet spinning the thus prepared dope solution into an aqueous alkaline coagulating bath.

3 Claims, 2 Drawing Sheets

SYNTHETIC POLYVINYL ALCOHOL FIBER AND PROCESS FOR ITS PRODUCTION

BACKGROUND OF THE INVENTION

1. Field of the Invention

The present invention relates to a synthetic polyvinyl alcohol (hereinafter sometimes referred to as PVA) fiber that has excellent mechanical features including high strength, high elastic modulus and abrasion resistance, can readily be pulpified. In particular, the invention relates to a synthetic PVA fiber that can be used in the industrial fields including reinforcement for composite materials, as well as in the fields of synthetic paper and replacement for asbestos.

2. Description of the Prior Art

PVA fiber has higher strength and elastic modulus than other general-purpose fibers, and has widely been used under a commercial name of "Vinylon" principally in the industrial field. In recent years it has also been used for reinforcing cement, as a replacement for asbestos. However, with the recent trend for requiring industrial materials exhibit still higher performance, there has also been increasing demand for PVA fiber with still higher strength and elastic modulus and with the capability of being pulpified, i.e. formed into extra-fine fibrils, like asbestos.

Experience with polyethylene proved that synthetic fibers with high strength and elastic modulus can be obtained by, besides employment of rigid liquid crystal polymers, conducting gel spinning of flexible general-purpose polymers with super-high molecular weights. Attempts have since been made to obtain high-performance fibers from general-purpose polymers. Thus, Japanese Patent Application Laid-open Nos. 100710/1984, 130314/1984, 108711/1986, etc. disclose techniques for producing PVA fiber with strength and elastic modulus considerably higher than conventional PVA fiber. However, the performance level of the fiber obtained by this technique does not yet reach that of superdrawn polyethylene fiber. The difference is considered to be due to the presence of strong intermolecular hydrogen bond in PVA. Where conventional gel spinning is employed, PVA fiber becomes whitened by drawing up to a ratio of 20 or so, and, if drawn more, the fiber will start decreasing in strength.

Conventional PVA fiber has been used as, making use of its high strength and hydrophilic property, replacement fiber for asbestos in the field of cement reinforcement and the like. It however has a problem in formability because it has a diameter as large as more than 10 times that of asbestos. That is, in the process of forming slate and the like, if a reinforcing fiber has a large diameter, it will not sufficiently catch cement particles and hence will need to be mixed with natural pulp or the like. In the formation of brake disks or the like, PVA fiber which is not pulpified catches the resin to be reinforced only insufficiently as compared with asbestos, thereby decreasing the strength of green material. It has therefore been difficult to replace asbestos in this field by conventional PVA fiber. In the field of synthetic paper also, pulpified PVA fiber having thinner fineness would produce higher grade paper.

Spinning of high-performance synthetic fiber through a spinneret having microfine holes has been attempted only to prove there is a limit of fineness attainable by physical finization. There has also been desired a fiber that pulpifies first when thrown into a wet refiner, since pulpified fiber having the shape of separate short-cut filaments is difficult to handle during processes prior to the wet refinery.

In consideration of the foregoing, an object of the present invention is to provide a synthetic PVA fiber that can be superdrawn and has excellent mechanical properties, and can be pulpified.

Another object of the present invention is to provide a synthetic PVA fiber having the above characteristics and suffering from no whitening.

The present inventors thought the fact that a single filament consists of infinite number of fibrils can make it possible to realize high strength and elastic modulus by superdrawing, and also thought that the very fact could make it possible to pulpify the filament. To realize the idea in PVA fiber, the present inventors have discovered improvements in the dope stage of the fiber and found a process that can make the fiber be formed of an aggregate of fibrils already at the stage of as-spun (before heat drawing) fiber, to complete the invention.

SUMMARY OF THE INVENTION

The present invention provides a synthetic polyvinyl alcohol fiber comprising a polyvinyl alcohol having a polymerization degree of at least 1,500, said fiber showing in the transmission photomicrograph an interference pattern having innumerable slit-like disorder, having a pulpification ratio of at least 20% after being wet-beaten in a disk refiner and having a tensile strength of at least 15 g/denier.

The present invention also provides a process for producing a synthetic polyvinyl alcohol fiber, which comprises:

preparing a dope solution by dissolving a polyvinyl alcohol having a polymerization degree of at least 1,500 in an organic solvent, water or a mixture of an organic solvent and water and adding at least one surface active agent to the solution in an amount of 1 to 20% by weight based on the weight of the polymer, and wet or dry-jet-wet spinning the thus prepared dope solution into an aqueous alkaline coagulating bath.

BRIEF DESCRIPTION OF THE DRAWINGS

A more complete appreciation of the invenion and many of the attendant advantages will be readily obtained as the same become better understood by reference to the following detailed description when considered in connection with the accompanying drawings, wherein:

FIGS. 1 through 4 are transmission interference photomicrographs of interference patterns showing inside higher-order structure of fibers, wherein FIGS. 1 and 2 are those of the PVA fiber (drawn) of the present invention, FIG. 3 that of conventional drawn PVA fiber before being whitened, and FIG. 4 that of the fiber of FIG. 3 further drawn to be whitened.

DETAILED DESCRIPTION OF THE PREFERRED EMBODIMENTS

Figure 1:
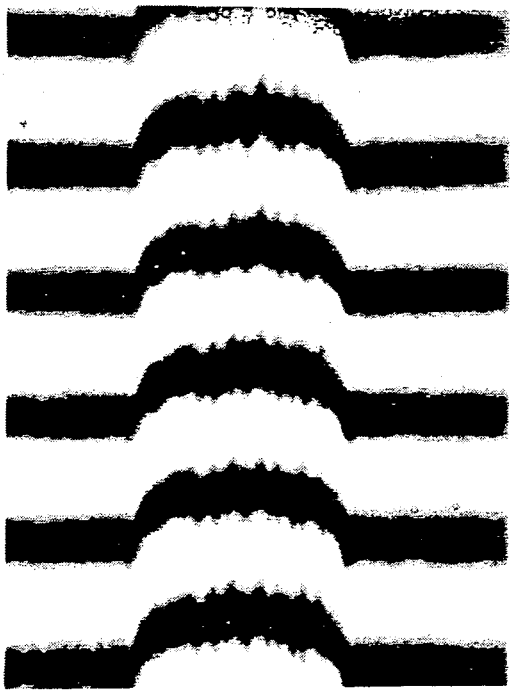
Figure 2:
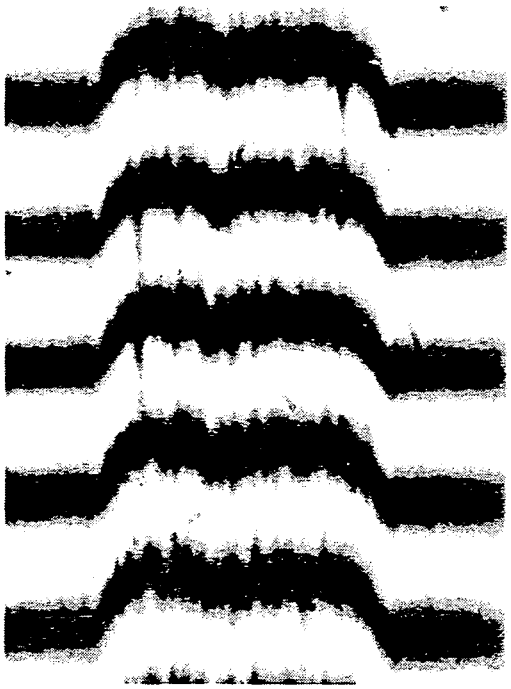
Figure 3:
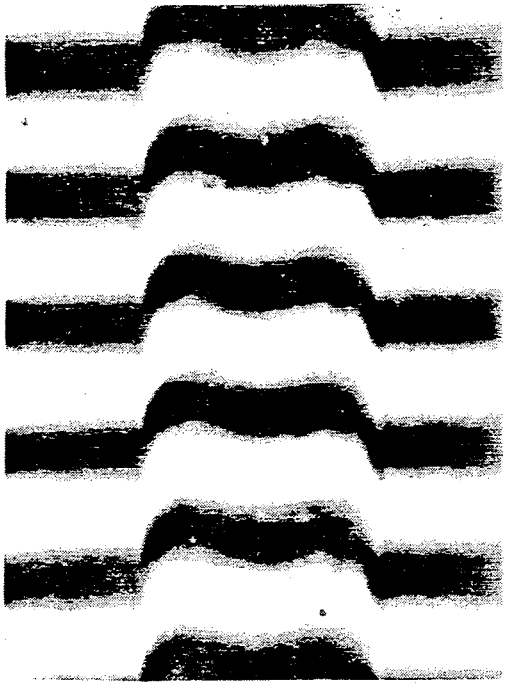
Figure 4:
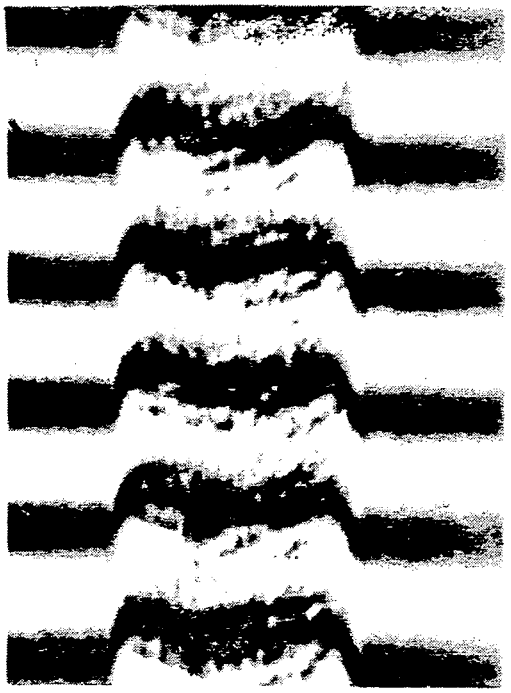

In the PVA fiber of the present invention, each single filament is composed of an aggregate of innumerable fibrils. This fact makes it possible to conduct superdrawing of the fiber accompanied by slippage between the fibrils, thereby realizing high strength, high elastic modulus and like properties. This fact is also a prerequisite for the pulpification of a fiber in a wet refiner, which has, with PVA fiber, been first realized according to the present invention. The term "fibril" used herein means a continuous linear higher-order structure extending along the fiber axis, and is thus different from transversal stripes extending radially across a filament cross section, i.e. microvoids, which are observed in conventional fibers. The presence of the fibril structure can be confirmed by observing the interference pattern with a transmission interference microscope. The interference pattern reveals, in principle, a disorder of molecules being closely packed. FIGS. 1 and 2 are examples of the photographs of the superdrawn synthetic PVA fiber with high strength of the present invention. As seen from the FIGURES, the pattern of the fiber of the present invention shows innumerable stripes (slit-like disorder) extending along the fiber axis, which indicates that the fiber is formed of an aggregate of innumerable fibrils. The present invention thus provides a high-strength synthetic PVA fiber comprising an aggregate of innumerable fibrils. FIG. 3 is an example of the photograph of a conventional drawn synthetic PVA fiber, which does not show stripes extending along fiber axis, that are seen in FIG. 1 or 2, indicating that there is no aggregate of fibrils. In other words, this fiber does not have a structure of fibril aggregate. FIG. 4 is a photograph of the fiber of FIG. 3 further drawn to achieve still higher strength. The photograph shows newly developed stripes along the fiber axis, proving the formation of a fibril aggregate, but, at the same time, also shows innumerable stripes in a direction perpendicular to fiber axis, proving substantial development of voids and so shows the progress of structural destruction.

There is also available a process which comprises developing fibrillation by drawing by force a material having an incomplete higher-order structure to obtain what is known as split yarn. However, the yarn obtained by this or like processes is, as seen from FIG. 4, pregnant with internal structural destruction and is of a low strength level, being hence no object of the present invention.

The fiber aimed at by the present invention must have a tensile strength of at least 15 g/denier, preferably at least 17 g/denier, this level of strength being required to meet still increasing requirements for PVA fiber with the recent trend of demanding higher-performance materials in the industrial fields.

The fiber of the present invention has, as described above, a structure of aggregate of innumerable fibrils and has therefore a high pulpification ratio while maintaining its high mechanical properties.

The term "pulpification ratio" is used for further indicating the degree of the above-mentioned fibrillation, and is determined by observing with an optical microscope the slurry of a specimen fiber wet-beaten in a disk refiner. The pulpification ratio of the novel synthetic PVA fiber of the present invention is at least 20%, preferably at least 50%. Where the pulpification ratio is less than 20%, the above-mentioned interference stripes are, if ever observed, due to structural destruction, and the fiber cannot be fibrilized to such an extent that can allow it to sufficiently catch cement particles or the like and thus replace asbestos.

The present invention further provides a synthetic PVA fiber having, in addition to the above features, a density at 25° C. of at least 1.30 g/cm$^3$. Fiber density has been used as a measure for the crystallinity of the fiber. Thus, the degree of crystallinity of a fiber is calculated from its density on the assumption that there holds additivity with respect to the density of the complete crystalline polymer and that of the complete amorphous polymer. In the present invention however, the density of at least 1.3 g/denier means, a little different from the above, no microvoids and whitening having been generated by superdrawing. It has been difficult in practice to obtain a continuous fiber having a density of at least 1.3 g/d, and a drawn fiber having a degree of crystallinity as determined by X-ray diffractometry of at least 70%, which theroretically gives a density of about 1.31 g/denier does generally decrease its density to about 1.29 g/denier when it is whitened by drawing. The present invention provides, a continuous PVA fiber without being whitened and having a density at 25° C. of at least 1.3 g/denier, by virtue of a fibril-aggregate structure. This absence of microvoids is a very important factor contributing to the abrasion, hot water and chemical resistance of the fiber.

The present invention still further provides a synthetic PVA fiber having, in addition to the above features, a refractive index in a direction perpendicular to the fiber axis of at least 1.525. This high refractive index physically means a sufficient development of higher-order structure including molecular orientation, etc. and no generation of structural defects such as the afore-mentioned microvoids in the synthetic PVA fiber. When conventional synthetic PVA fiber is being continuouly drawn, the refractive index in a direction perpendicular to fiber axis increases with increasing molecular orientation but then decreases, same as in the case of density above, with development of whitening. A synthetic PVA fiber having a refractive index of at least 1.525 was first obtained by superdrawing a fiber of fibrilaggregate structure according to the present invention.

As described heretofore, the fiber of the present invention has high strength and is of structure comprising an aggregate of microfibrils, and as a still preferred condition, has the above-mentioned higher-order structure that does not cause whitening.

Described next are the principal thought for obtaining the fiber of the present invention and the process for producing the fiber.

It is most important for producing the fiber having a novel higher-order structure according to the present invention to develop a phase-separated structure along the fiber axis in the fiber coagulated after passing a nozzle and to maintain the phase-separated structure as much as possible until the drawing process.

Such a phase-separated structure might be developed by a process which comprises having a dope contain emulsified particles already comprising a phase-separated structure and then spinning the dope; or, where a dope of uniform solution is first prepared, by passing the dope through a spinneret and developing a phase-separated structure in the spun filaments during the coagulation process by decreasing temperature to gelling of the filaments, selecting proper conditions for extracting the solvent, or the like.

We propose, to achieve the above object, a process which comprises preparing a spinning dope by adding 1 to 20% by weight based on the weight of PVA of at least one surface active agent to a solution obtained by dissolving PVA in an organic solvent, water or a mixture thereof and wet or dry-jet-wet spinning the dope into an aqueous alkaline coagulating bath.

The PVA polymer used has a viscosity average polymerization degree as determined from an inherent viscosity with its aqueous solution at 30° C. of at least 1,500, preferably at least 3,000. PVA with a polymerization degree of less than 1,500 often does not give the desired strength; and fibers with increaing polymerization degree will exhibit higher performances. The preferred saponification degree of the PVA is at least 95 mol % but not limited thereto since it depends on the type of solvent, process employed and the like. The PVA may be one having copolymerized other vinyl compounds in amounts of not more than 2 mol %.

Examples of the solvents used for dissolving the PVA are, among others, polyhydric alcohols such as ethylene glycol, trimethylene glycol, diethylene glycol and glycerine, dimethyl sulfoxide, dimethylformamide, diethylenetriamine, water, mixtures of the foregoing, and aqueous thiocyanate solutions.

It is known that, when a PVA dope is spun into an aqueous alkaline coagulating bath, boric acid or borates is added to the PVA dope. In the present invention this addition may also be acceptable. As later described herein, the coagulating bath in the process of the present invention is preferably composed of a system that does not positively extract the surfactant from filaments extruded through a spinneret, and an aqueous coagulating bath is hence employed. In this case it is preferred that boric acid or a borate be added to the dope to accelerate gellation in the coagulating bath, while it is also preferred for the same purpose that the coagulation bath be alkaline. The amount of boric acid or the like added is 0.1 to 10% by weight based on the weight of PVA, more preferably 0.5 to 5% on the same basis. An organic acid such as acetic acid, tartaric acid or oxalic acid may also be added to adjust the pH of the dope. Besides, additives such as antioxidant and ultraviolet absorber may also be added.

The surface active agent added may be anionic, cationic, amphoteric or nonionic and may be used singly or in combination. The amount suitably added is 1 to 20% by weight based on the weight of PVA. If the addition is less than 1% by weight, the surfactant cannot form a phase-separated structure in the fiber as spun. On the other hand, if the addition exceeds 20% by weight, coagulation and solidification will be insufficient, thereby causing single filaments to stick to each other, and it will be impossible to conduct superdrawing to obtain the desired fiber.

As the surfactant capable of forming a phase-separated structure, nonionic ones are particularly effective and they are added preferably in an amount of at least 3% by weight based on the weight of PVA.

Examples of preferred nonionic surfactants are polyethylene glycol type such as higher alcohol-ethylene oxide adduct, alkylphenol-ethylene oxide adduct, fatty acidethylene oxide adduct, polyhydric alcohol fatty acid esterethylene oxide adduct and higher alkylamine-ethylene oxide adduct and polyhydric alcohol type, e.g. fatty acid esters of polyhydric alcohol such as glycerol, pentaerythritol, sorbitol, glucose and sucrose, and alkyl ethers of polyhydric alcohol. These surfactants preferably have an HLB value of at least 6.

Where the PVA dope is an aqueous solution, particularly preferred surfactants are the above-mentioned nonionic surfactants of polyethylene glycol type having an HLB of 12 to 19. Where the PVA is dissolved in an organic solvent, preferred surfactants are the above-mentioned nonionic surfactants of polyhydric alcohol type, particularly fatty acid esters of cyclic polyhydric alcohol such as sucrose.

In forming phase-separated emulsion particles in a dope, the emulsion preferably has a particle diameter as small as possible from the viewpoint of dope stability, spinnability, strength of obtained fiber and the like. The particle diameter is thus not more than 100μ, preferably not more than 50μ, more preferably not more than 20μ. The emulsion particles can be made fine by a mechanical process comprising stirring or vibrating with a mixer or the like, or by a chemical process comprising adding to the dope, in addition to a nonionic surfactant, an anionic, cationic or amphoteric surfactant in an amount of 1 to 50% by weight based on the weight of the nonioic surfactant. The degree of this finization can be controlled by proper selection of stirring condition for the dope, dope temperature and the types of additives including surfactants.

The spinning temperature is preferably 60° to 140° C. It is, in particular, where the solvent of PVA is water, preferably 90° to 130° C. and, where the solvent is an organic solvent, preferably 70° to 100° C.

It is important that the spinning dope to which a surfactant has been added be spun in as short a time as possible, i.e. in 5 hours, preferably in 1 hour and more preferably in 30 minutes after the addition. It is therefore recommended that a surfactant be added batchwise or "in-line" to the PVA solution after dissolution and deaeration, and the dope be spun immediately thereafter.

The spinning can be conducted by wet spinning or by dry-jet-wet spinning. The dry-jet-wet spinning herein means a process which comprises, while placing a spinneret above and in a spaced relationship with the surface of coagulating bath, extruding the spinning dope once into a gas such as air and immediately thereafter introducing the extruded filaments into the coagulating bath to coagulate therein.

The coagulating bath to coagulate the filaments thus extruded is preferably composed of a system that does not positiively extract the surfactant contained in the extruded filaments because otherwise it will be difficult for the filaments to develop a phase-separated structure along fiber axis. Thus, aqueous alkaline coagulating bath, such as aqueous alkaline solution of sodium hydroxide having gellation ability is used. The above principle also holds, besides coagulation process, in processes thereafter until drawing process, where extraction of surfactant is suppressed to as low a level as possible, to permit the fiber just before drawing to contain the surfactant in an amount of at least 0.3% by weight, preferably at least 0.5% by weight, more preferably at least 1.0% by weight.

The aqueous coagulating bath must be alkaline to be able to gel the dope extruded, and conventional sodium sulfate or ammonium sulfate solution is not used because it causes skin-core struture to form in coagulated filaments. Caustic alkali such as sodium hydroxide or potassium hydroxide is used as the alkali, but some amounts of salts having dehydration ability, for example sodium sulfate, may also be used in combination. In the case of coagulating bath of alkali, for example sodium hydroxide, alone, the concentration is at least 250 g/l, preferably at least 300 g/l; while in the case where a salt is used in combination the concentrations of sodium hydroxide and the salt are at least 5 g/l and at least 200 g/l, respectively, the latter being preferably as close to that of saturation as possible.

There is no restriction as to the temperature of the coagulating bath. It however is preferably 55° to 95° C.

in the case where boric acid or a borate is added to the spinning dope. In this case, if the temperature is lower than 55° C., the fiber as spun will be of low drawability and not able to give a high strength fiber upon drawing. On the other hand if the temperature exceeds 95° C., the coagulating bath will boil and, besides, there will occur sticking between single filaments.

The thus gelled fiber leaving the coagulating bath is subjected to the successive treatments of wet drawing, neutralization of alkali, wet heat drawing, washing with water, drying, dry heat drawing and, as required, heat treatment. The wet drawing prior to neutralization is preferred since it protects the gelled fiber from swelling or surface dissolution caused by heat of neutralization. It is conducted in, for example, a high-concentration aqueous sodium sulfate solution at 80° C. and preferably in a ratio of at least 1.5 times. After the neutralization, the fiber is washed with water and dried. It is recommended that the fiber be wet and wet heat drawn during processes of the wet drawing through drying at a total draft of at least 2 times, preferably 3 to 6 times. This drawing decreases the swellability with water of the fiber, thereby suppressing sticking around rolls and between single filaments, and destroys minute crystals formed during extrusion through the spinneret to cause the molecular chains to be readily mobile, thereby rendering the fiber heat drawable in a high ratio.

After the drying, the fiber is heat drawn. For the fiber to achieve the high strength and elastic modulus aimed at by the present invention, it is preferably drawn at above 200° C. to a total draft inclusive of the above-described wet and wet heat drawing of at least 16 times, more preferably at above 220° C. to a total draft of at least 18 times.

The heat drawing can be conducted either by 1 step or by multiple steps, and by dry system, in oil bath, in an inert gas atmosphere or by zone drawing.

The fiber as spun from the dope containing a large amount of surfactant according to the present invention can be drawn at a higher draft ratio than in the case where no surfactant is added to the dope, thereby giving the fiber of the present invention.

As described heretofore, the synthetic PVA fiber of the present invention has high strength of at least 15 g/denier and high elastic modulus, and is excellent in resistances to abrasion, hot water and chemicals, as well as can readily be pulpified. The fiber of the present invention can therefore be used in the industrial fields including, in addition to conventionl uses of tire cord, ropes, cable, belt, hose, canvas, net and the like, uses for reinforcing cement or resins, friction materials, synthetic paper, nonwoven fabrics and the like.

Other features of the invention will become apparent in the course of the following descriptions of exemplary embodiments which are given for illustration of the invention and are not intended to be limiting thereof.

The various properties and parameters in the Examples and in the instant specification were measured according to the following methods.

1) TENSILE STRENGTH AND ELASTIC MODULUS

JIS L1013 is applied. A specimen multifilament yarn previously conditioned under an atmosphere of 20° C., 65% PH is tested by constant-rate-of-extension at a rate of 10 cm/min with the gauge length of 20 cm to give breaking load, elongation and initial elastic modulus. The fineness is determined by weight method.

2) DENSITY

Determined using a density-gravitation tube with a mixed solution of xylene/tetrachloroethane at 25° C.

3) OBSERVATION OF INTERFERENCE PATTERN AND DETERMINATION OF REFRACTIVE INDEX

The interference pattern is observed through a transmission interference microscope (PERAVAL Interphako ®, made by Carl Zeiss Jena Co.) with a monochrom light of 589 nm.

The refractive index is measured by sealing a specimen fiber with 2 liquids having different refractive indexes, taking photographs of the two interference patterns with a Polaroid camera, and measuring the interference stripes, according to the method described in Japanese Patent Application Laid-open No. 35112/1973 (du Pont).

4) PULPIFICATION RATIO

Specimen fiber is cut to chips having a length of 1 mm, and the chips are dispersed in water to a concentration of 5 g/l. The mixture is passed 3 times through a disk refiner (Type KRK, made by Kumagai Riki Kogyo Co.) with no clearance at a rate of 5 l/min. From the thus obtained dispersion is taken 0.2 mg sample and the sample is observed under a transmission type optical microscope, and the numbers of two different filament shapes are counted.

The filaments observed are classified into "fibrillated fiber" and "non-fibrillated fiber" as defined in this specification as below.

Fibrillated Fiber

Single filament assuming a feather-like shape in which multiplicity of minute fibrils come out from the trunk filament, a cotton-wadding-like shape in which no trunk is observed already, or still a trunk-shape which however contains a plurality of cracks, just before being split, along fiber axis.

Non-Fibrillate Fiber

Single filament maintaining its shape before being passed through a refiner and showing no cracks along fiber axis.

The pulpification ratio is defined herein to be the ratio of the fibrillated fiber to the total.

EXAMPLES

Example 1 and Comparative Examples 1 and 2

A PVA having a polymerization degree of 3,500 and a saponification degree of 99 mol % was dissolved in water to a concentration of 12% by weight, and to the solution boric acid was added in an amount of 2% by weight based on the weight of PVA. Dope solutions were prepared by adding to the solution obtained above nonylphenol-ethylene oxide adduct (20 moles) in amounts of 0% by weight (Comparative Example 1), 5% by weight (Example 1) and 25% by weight (Comparative Example 2), respectively, based on the weight of PVA. The dopes thus prepared were each wet spun through a spinneret having 600 circular holes of 0.08 mm diameter into an aqueous coagulating bath (1st bath) containing 20 g/l of sodium hydroxide and 320 g/l of sodium sulfate at 70° C. and allowed to leave the bath at a rate of 6 m/min. The fiber was then, in the usual manner, successively rollerdrawn, neutralized, wet heat drawn, washed, dried, heat stretched at 240° C. and taken up onto a bobbin to give a filament yarn of 1,200 deniers/600 filaments.

The properties together with the manufacturing conditions of the PVA fibers thus obtained are shown in Table 1. In Comparative Example 2, the fiber could not be heat drawn due to bitter sticking between single filaments which occurred during drying.

TABLE 1

| | Example 1 | Comparative Example 1 | Comparative Example 2 |
|---|---|---|---|
| Polymerization degree | 3,500 | 3,500 | 3,500 |
| Solvent | water | water | water |
| Amount of surfactant added (wt %/PVA) | 5.0 | 0 | 25.0 |
| Total draft (times) | 31 | 24 | could not be drawn |
| Yarn strength (g/d) | 25.1 | 21.0 | — |
| Elongation (%) | 4.0 | 5.4 | — |
| Elasic modulus (g/d) | 480 | 350 | — |
| Whitening | no | yes | — |
| Interference stripes along fiber axis | yes | no | — |
| Density (g/cm$^3$) | 1.305 | 1.291 | — |
| Refractive index in a direction perpendicular to fiber axis | 1.529 | 1.518 | — |
| Pulpification ratio (%) | 93 | 5 | — |

In contrast to Comparative Example 1 where no surfactant had been added, in Example 1 where the surfactant had been added in an amount of 5% by weight based on the weight of PVA the total draft of not less than 30 was possible without generation of whitening. FIG. 1 shows the interference photomicrograph of the fiber obtained in Example 1. As apparent from FIG. 1, innumerable stripes extend along fiber axis indicating progress of fibillation deep into the inside, and there is no radial stripes, which indicates that no structural destruction has occurred due to generation of voids.

On the other hand, observation in the same manner as above of the fiber in Comparative Example 1, taken out midway of heat drawing, before being whitened, revealed that, as shown in FIG. 3, there was no lengthwise stripes at all, indicating no development of fibril-aggregate structure. The fiber further heat drawn was whitened, and its microscopic observation showed innumerable stripes also in a direction perpendicular to fiber axis, which indicates generation of voids, rather than fibrils, having resulted in structural destruction. The fiber obtained in Example 1, according to the present invention, has, as shown in Table 1, high density and refractive index in a direction perpendicular to fiber axis, has high strength and elastic modulus, and can readily be pulpified.

The fiber obtained in Example 1 was cut to chips of 3 mm length, and the chips were, instead of asbestos, dispersed in cement slurry to form a slate. The properties and appearance of the obtained slate was good. While it has been customary to use for this purpose conventional PVA fiber in combination with some amount of cellulose pulp since the former by itself does not catch cement particles sufficiently, the PVA fiber of the present invention needs no such addition of cellulose pulp, and is thus very useful.

Examples 2 and 3 and Comparative Examples 3 Through 5

A PVA having a polymerization degree of 3,300 and a saponification degree of 99.5% and boric acid were dissolved in a mixed solvent of dimethyl sulfoxide (hereinafter referred to as DMSO) and water (weight ratio of DMSO/water=7/3) at 90° C. to prepare a dope solution containing PVA in a concentration of 11% by weight based on the weight of the dope solution and boric acid in an amount of 2.2% by weight based on the weight of PVA. Separately, a nonionic polyhydric alcohol-based surfactant composed of sucrose and a fatty acid ester having 16 carbon atoms is dissolved in DMSO at 50° C. to give 10% by weight solution. The two solutions were each metered through a gear pump and then mixed through a 36-element static mixer. The mixture was wet spun through a spinneret with 300 holes having a diameter of 0.11 mm into a coagulating bath containing 8 g/l of sodium hydroxide and 250 g/l of sodium sulfate at 80° C. and allowed to leave the bath at a rate of 4 m/min. There, the flow rate at the gear pump metering the surfactant solution was changed such that the amounts of the surfactant added to the PVA would be 0% (Comparative Example 3), 0.5% (Comparative Example 4), 4% (Example 2), 8% (Example 3) and 25% (Comparative Example 5) all by weight based on the weight of the PVA. Comparative Example 3 did not contain any surfactant, and is hence for control. The obtained fibers leaving the bath were each successively, in the usual manner, roller drawn, neutralized, wet heat drawn, washed, dried and heat drawn at 236° C. in this order to give a filament yarn of 750 deniers/300 filaments. The total draft for each fiber was set to 0.95 times that which caused fluffs to start generating. The properties together with the manufacturing conditions of the PVA fibers thus obtained are shown in Table 2.

TABLE 2

| | Example | | Comparative Example | | |
|---|---|---|---|---|---|
| | 2 | 3 | 3 | 4 | 5 |
| Amt of surfactant added (wt %/PVA) | 4.0 | 8.0 | 0 | 0.5 | 25 |
| State of dispersion in dope | many minute particles having a dia. of 10μ or below | same as left | no particles | almost no particles | some large particles |
| Total draft (times) | 20.0 | 20.5 | 17 | 17.5 | |
| Yarn properties | | | | | |
| Strength (g/dr) | 24.1 | 24.8 | 20.1 | 20.5 | stickened |
| Elongation (%) | 4.5 | 4.3 | 4.8 | 4.8 | |
| Elastic modulus (g/d) | 460 | 450 | 400 | 410 | |
| Whitening | no | no | completely whitened | same as left | — |
| Interference stripes along fiber axis | yes | yes | no | no | — |
| Density (g/cm$^3$) | 1.310 | 1.308 | 1.294 | 1.296 | — |

TABLE 2-continued

| | Example | | Comparative Example | | |
|---|---|---|---|---|---|
| | 2 | 3 | 3 | 4 | 5 |
| Refractive index in a direction perpendicular to fiber axis | 1.530 | 1.531 | 1.520 | 1.522 | — |
| Pulpification ratio (%) | 83 | 45 | 3 | 11 | — |

As apparent from Table 2, the drawn fiber of Examples were able to be drawn to a large total draft, and had high density and refractive index in a direction perpendicular to fiber axis. They had a good luster without being whitened and had high strength and elastic modulus. These fibers were found to be excellent in resistances to water and fatigue. Observation of these fibers obtained in Examples with an interference microscope revealed, as shown in FIG. 2, that they showed innumerable stripes along fiber axis but no stripes at all in a direction perpendicular to fiber axis. They were also able to be readily pulpified.

On the other hand, observation in the same manner of the fiber obtained in Comparative Example 3 revealed that this fiber showed almost no slit-like disorder of the interference pattern along fiber axis, but showed innumerable stripes in a direction perpendicular to fiber axis, indicating its structural destruction caused by generation of voids.

Obviously, numerous modifications and variations of the present invention are possible in light of the above teachings. It is therefore to be understood that within the scope of the appended claims, the invention may be practices otherwise than as specifically described herein.

What is claimed is:

1. A synthetic polyvinyl fiber comprising a polyvinyl alcohol having a polymerization degree of at least 1,500, said fiber having a structure of an aggregate of innumerable fibrils, showing in the transmission microphotograph an interference pattern having innumerable slit-like disorder, having a pulpification ratio of at least 20% after being wet-beaten in a disk refiner and having a tensile strength of at least 15/g denier.

2. A synthetic polyvinyl alcohol fiber according to claim 1, said fiber further having a density at 25° C. of at least 1.30 g/cm$^3$.

3. A synthetic polyvinyl alcohol fiber according to either claim 1 or claim 2, said fiber further having a refractive index in a direction perpendicular to fiber axis of at least 1.525.

* * * * *